US005930935A

United States Patent [19]

Griffin

[11] Patent Number: 5,930,935

[45] Date of Patent: Aug. 3, 1999

[54] METHOD AND APPARATUS FOR ATTACHING A SUPPLEMENTAL DEVICE TO AN UNALTERED HOST FIREARM

[75] Inventor: Todd Griffin, Miami, Fla.

[73] Assignee: R/M Equipment, Inc., Miami, Fla.

[21] Appl. No.: 09/152,233

[22] Filed: Sep. 11, 1998

Related U.S. Application Data

[60] Provisional application No. 60/058,553, Sep. 11, 1997.

[51] Int. Cl.[6] ..... F41C 27/06

[52] U.S. Cl. ..... 42/105; 42/77; 42/85; 42/86

[58] Field of Search ..... 42/105, 77, 85, 42/86

[56] References Cited

U.S. PATENT DOCUMENTS

| | | | |
|---|---|---|---|
| 3,243,909 | 4/1966 | Kotikov | 42/1 |
| 3,442,173 | 5/1969 | Muller | 89/127 |
| 4,689,911 | 9/1987 | White | 42/105 |
| 4,733,489 | 3/1988 | Kurak | 42/77 |

*Primary Examiner*—Charles T. Jordan
*Assistant Examiner*—Meena Chelliah
*Attorney, Agent, or Firm*—Nawrocki, Rooney & Sivertson, P.A.

[57] ABSTRACT

An interbar assembly (34) for reversibly attaching a supplemental device, e.g., grenade launcher (32), to a host weapon, e.g., rifle (10). A preferred interbar assembly attaches at its forward end to the bayonet lug (54) of rifle (10), and at its rearward end to the magazine well (31) of rifle (10). In a preferred embodiment, such connection can be made without the need for special tools and without altering the rifle in any way prior to making the connection. The invention also includes a supplemental sling strap attachment point (100), so the sling strap (29) can be readily relocated after attaching the grenade launcher (32), for example, to the rifle (10). Another aspect of the invention is a grenade launcher (for example) sight (104) mounted directly on the interbar assembly (34) that carries the grenade launcher (32).

12 Claims, 5 Drawing Sheets

METHOD AND APPARATUS FOR ATTACHING A SUPPLEMENTAL DEVICE TO AN UNALTERED HOST FIREARM

CROSS REFERENCE TO RELATED APPLICATIONS

This is a regular application filed under 35 U.S.C. §111(a) claiming priority, under 35 U.S.C. §119(e)(1), of provisional application Ser. No. 60/058,553, previously filed Sep. 11, 1997, under 35 U.S.C. §111(b).

TECHNICAL FIELD

The present invention relates broadly to the field of firearms. More narrowly, the invention relates to rifle technologies and to specifics of that field dealing with attaching supplemental devices, e.g. grenade launchers, to such weapons.

BACKGROUND OF THE INVENTION

As warfare has progressed through the ages, weapons more and more sophisticated have evolved. Of course, weapons have become more powerful and accurate. And they have also become more compact, more reliable, lighter weight and easier to operate, to maximize their overall effectiveness. But most weapons, even modem weapons, are "dedicated" in the sense that they are capable of delivering only one type of projectile. The present invention relates to reversibly configuring a single hand-held weapon such that it is capable of delivering multiple types of projectiles. More particularly, the present invention relates to quick attaching/detaching a supplemental launching device, preferably a grenade launcher, to an automatic rifle such as an M16, thus increasing the versatility and effectiveness of the M16; and doing so in such a way that the M16 needn't be materially altered to accept the supplemental device.

It should be noted that a commonly-assigned copending application discloses a method and apparatus for attaching a supplemental device to a host weapon that is minimally altered, in the field, preferably by removing a portion of its hand guard. Such an approach has many advantages, including minimizing the weight and complexity of the supplemental device individually, and of the host/supplemental device combination as well. But the present invention, in its most preferred form, possesses a significant and unique advantage: it permits a supplemental device (e.g., grenade launcher) to be quickly and easily secured to a host weapon without any prior alterations of the host weapon whatsoever. This unique advantage is discussed at length below.

As noted above, the present invention relates to automatic and semiautomatic rifles. The automatic rifle is a weapon that can fire a number of rounds in quick succession. Such operation is accomplished in view of the fact that the functions of firing and reloading are performed by the weapon itself. These functions include firing the cartridge, withdrawing the bolt, ejecting the spent cartridge case, cocking the hammer, forcing the bolt forward, and inserting a fresh cartridge into the chamber ready to fire. The energy for performing these functions is provided in one of two ways: by the pressure of the gas produced by the firing of the cartridges (in gas operated weapons) or by the recoil of the weapon itself. The M16 is one particularly effective type of automatic rifle, and the present invention will be described with the M16 as an example; but those skilled in the art will understand that in no way is the invention limited to the M16.

Another type of weapon which has altered the face of conventional warfare is the grenade launcher. The M79 grenade launcher is a shoulder fired weapon which has been used by the U.S. Army now for some time. While the effectiveness of hand-thrown grenades is limited in both distance and accuracy, weapons such as the M79 improve the accuracy with which a grenade can be projected and certainly greatly extend the distance over which grenades can be projected.

The M79 grenade launcher is a dedicated weapon. That is, it is used for one purpose and not in combination with other weapons.

More recently, the M203 grenade launcher has been developed and implemented as a weapon system in the arsenal of the armed forces of the United States. The M203 is the successor of the M79. The desirability of the M203 as compared to the M79 resides in the fact that it fulfills a requirement for a rifle/grenade launcher 25 package, whereas the M79 was only a dedicated grenade launcher.

The M203 is a weapon system that, when operational, is attached to an M16 rifle. Although relatively light in weight, it nevertheless does add some additional weight to the rifle with which it is used. Optimally, the weapon carried by an infantry soldier should be as light as possible at any particular time.

The prior art includes various techniques for reversibly configuring an M16 rifle to accept a M203 grenade launcher. One such technique is disclosed in commonly-assigned U.S. Pat. No. 4,733,489. The '489 technique involved the clamping of an "upper rack" to the underside of the barrel of an M16, using threaded fasteners or the like. A "lower rack" was secured to the upper surface of a M203 grenade launcher, also using threaded fasteners or the like. The upper and lower racks were designed to be easily and quickly connected and disconnected to one another in the field, thereby reversibly connecting the grenade launcher to the rifle, without the need for tools or threaded fasteners.

The '489 technique was advantageous over previous techniques in that the lower and upper racks, respectively, could be assembled to the grenade launcher and rifle well ahead of time. In the field, then, all that was required was for the operator to make a quick, no-tools connection of the lower rack/grenade launcher assembly to the upper rack/rifle assembly. The only disadvantage of the '489 approach, as perceived by Applicant, is that the '489 technique requires either that the upper rack be attached to the rifle in the field, a process that can take several minutes and require tools and the handling of small threaded fasteners; or that the upper rack be pre-installed, which then results in an increase in the weight of the M16, as well as a change in the balance of the weapon.

In a preferred embodiment, the present invention is both a method and apparatus for allowing selective and rapid configuration and reconfiguration of an automatic rifle as a grenade launcher, wherein there is no need to pre-install an upper rack or the like on the rifle and wherein the entire rack or bar assembly, sometimes called the "interbar," can be attached to or integral with the grenade launcher; and wherein the grenade launcher/interbar combination can be quickly and easily reversibly attached to an unaltered (i.e., unaltered in any material way) rifle in the field, without the need for tools. As such, the present invention solves problems existent in the prior art and satisfies requirements dictated by the need for light weight and efficient, easy-to-use weapon systems.

Applicant has also perceived another potential problem with prior art techniques for attaching a supplemental device, e.g., a grenade launcher assembly, to a rifle, relating to the sling strap of the rifle. In the past, when a grenade launcher was attached to a host weapon, the forward sling strap attachment would have to be modified to move the strap out of the trajectory of the grenade launcher. Usually this was done by the addition of a supplemental forward sling strap attachment point, using tools, on the host weapon itself. Alternatively, operators often improvised various informal ways of attaching the sling strap to the host. One aspect of the present invention obviates the need for modifying the host weapon, or informal modifications of the sling strap in the field.

Finally, Applicant has perceived the need for a sight on a combination host weapon/supplemental device (e.g., automatic rifle/grenade launcher) for the supplemental device, without requiring modification of the host weapon or the use of tools or the like. A preferred such sight would be easily adjustable, usable on either side of the weapon, and be easily and ambidextrously adjustable for windage and elevation, preferably without the need for special tools that may not be readily available in the field. One aspect of the present invention addresses this need as well.

Thus, the present invention addresses the problems discussed above with prior art weapons. In particular and in its most preferred embodiment, the present invention provides a method and apparatus for quickly and easily attaching a supplemental device such as a grenade launcher to a host weapon such as an automatic rifle, without materially altering or adding weight to the host weapon (that is, prior to the supplemental device being attached); a technique for handling the sling strap of a host weapon when a supplemental device is attached; and a way to provide a sight for the supplemental device without having to permanently modify the host weapon.

SUMMARY OF THE INVENTION

One aspect of the present invention is an interbar assembly for reversibly attaching a supplemental device (e.g., grenade launcher) to a host weapon (e.g., M16 rifle) having, for example, a magazine well and a bayonet lug. The interbar assembly in this embodiment of the present invention includes an elongated interbar carrying the supplemental device; an interbar front mount that reversibly connects to the bayonet lug; and an interbar rear mount that reversibly engages the magazine well, whereby the interbar assembly and the supplemental device are secured to the host weapon. In this particular embodiment, the interbar is not integral with the supplemental device, and the two are connected together, preferably using threaded fasteners.

Another aspect of the present invention is a system for attaching a supplemental device assembly to a host weapon having a breech bracing structure and a bayonet attachment point. The system includes a supplemental device assembly front mount for connecting to the bayonet attachment point; and a supplemental device rear mount for engaging the breech bracing structure, whereby the supplemental device assembly is secured to the host weapon. The supplemental device assembly can include a supplemental device such as a grenade launcher and an interbar, and the host weapon can be an M16 rifle.

Still another aspect of the invention is a supplemental sling strap attachment point located on the interbar or interbar/supplemental device assembly, wherein the barrel end of the sling strap may be relocated from the normal barrel sling strap attachment point to the supplemental sling strap attachment point when the interbar or interbar/supplemental device assembly is attached to the host weapon.

Still another aspect of the invention is a supplemental device sight located on the interbar or interbar/supplemental device assembly.

Additional embodiments, aspects, and features of the present invention are discussed below with reference to the attached drawings.

DETAILED DESCRIPTION OF PREFERRED EMBODIMENT

Figure 1:
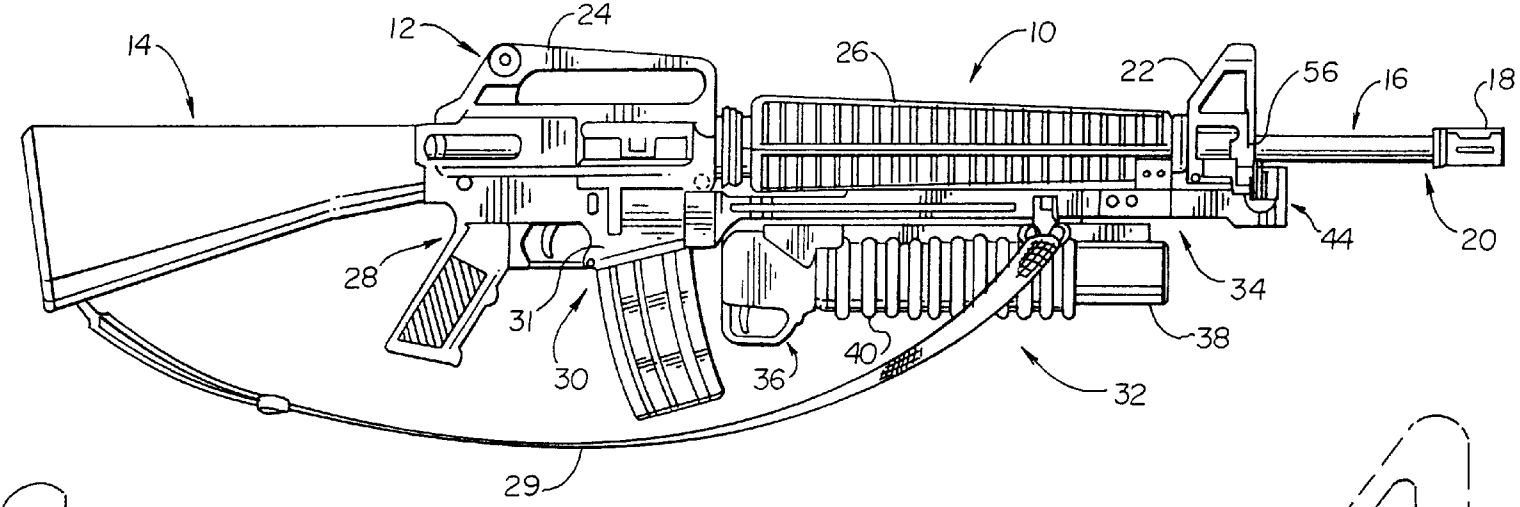
FIG. 1 is a right side elevational view of an automatic rifle reconfigured in accordance with the present method and apparatus inventions and with a grenade launching device attached thereto by means of an interbar assembly.

Referring now to the drawings wherein like reference numerals denote like elements throughout the several views, FIG. 1 illustrates an automatic rifle 10 upon which the present method invention can be practiced, carrying a grenade launcher 32. Rifle 10 is sometimes referred to as the "host firearm" or "host weapon" or "host" herein, and while other types of host firearms are contemplated the preferred host firearm is an M16 automatic rifle. Grenade launcher 32 is sometimes referred to as the "supplemental device" herein, and while other types of supplemental devices are contemplated the preferred such device is an M203 style grenade launcher.

During the course of the following discussion, reference is occasionally made to such descriptions as horizontal, vertical, top, bottom, front, rear, etc. Such descriptions assume, unless stated or implied otherwise, that host weapon 10 is oriented as shown in FIG. 1, i.e., in such a way that the barrel is horizontal and the weapon is in its normal, upright orientation as during normal use. The "right" side of weapon 10 is the side shown in FIG. 1.

Rifle 10, a preferred host firearm, includes a central breech portion 12, a butt 14 extending rearwardly from the breech portion 12, a barrel 16, having a flash arrester 18 at the forward end 20 thereof, extending forwardly from the breech portion 12, a forward sight 22, a transport handle 24 which includes a rear sight (not shown), a hand guard 26 intermediate the forward sight 22 and the transport handle 24, a grip and trigger assembly 28, a sling strap 29, and a magazine 30. Magazine 30 includes a magazine well 31, the significance of which is discussed below.

Attached to rifle 10, as depicted in FIG. 1, is a "supplemental device," preferably grenade launcher 32, and most preferably an M203 grenade launcher. The grenade launcher 32 is mated to rifle 10, beneath the hand guard 26 of same, by use of an apparatus according to the present invention, called an "interbar assembly," and designated generally herein with reference numeral 34. The grenade launcher 32, connected to and suspended from the interbar assembly 34, includes a trigger mechanism portion 36, a barrel 38, and its own hand guard 40 encircling a portion of the barrel 38.

An important aspect of the present invention relates to the interbar assembly 34, and particularly to the way in which the interbar assembly 34 (and the supplemental device 32 carried with or by interbar assembly 34) attaches to rifle 10 or other host firearm. It should be emphasized that the interbar assembly 34 can be joined to launcher 32 using threaded fasteners or the like, as shown and described herein as a preferred embodiment; interbar interbar assembly 34 can also be permanently attached to or even integral with the grenade launcher 32. For example, and not by way of limitation, an interbar assembly according to the present invention could actually be an integral part of the receiver of the grenade launcher or other supplemental device. Or the interbar assembly could be welded, for example, to the supplemental device. The present invention is not limited to any particular interbar/supplemental device connection or integration scheme.

Referring primarily to FIGS. 2, 5, 6 and 7, interbar assembly 34 includes an elongated bar 42, preferably constructed from a high strength metal such as steel. Bar 42 may be fabricated in various ways, for example by milling and drilling bar stock. Attached at the forward end of bar 42 is a front mount 44; and attached at the rearward end of bar 42 is a rear mount 46. Mounts 44 and 46 will be discussed in detail below, as they are the attachment points between the interbar assembly 34 and the host weapon 10.

Figure 8:
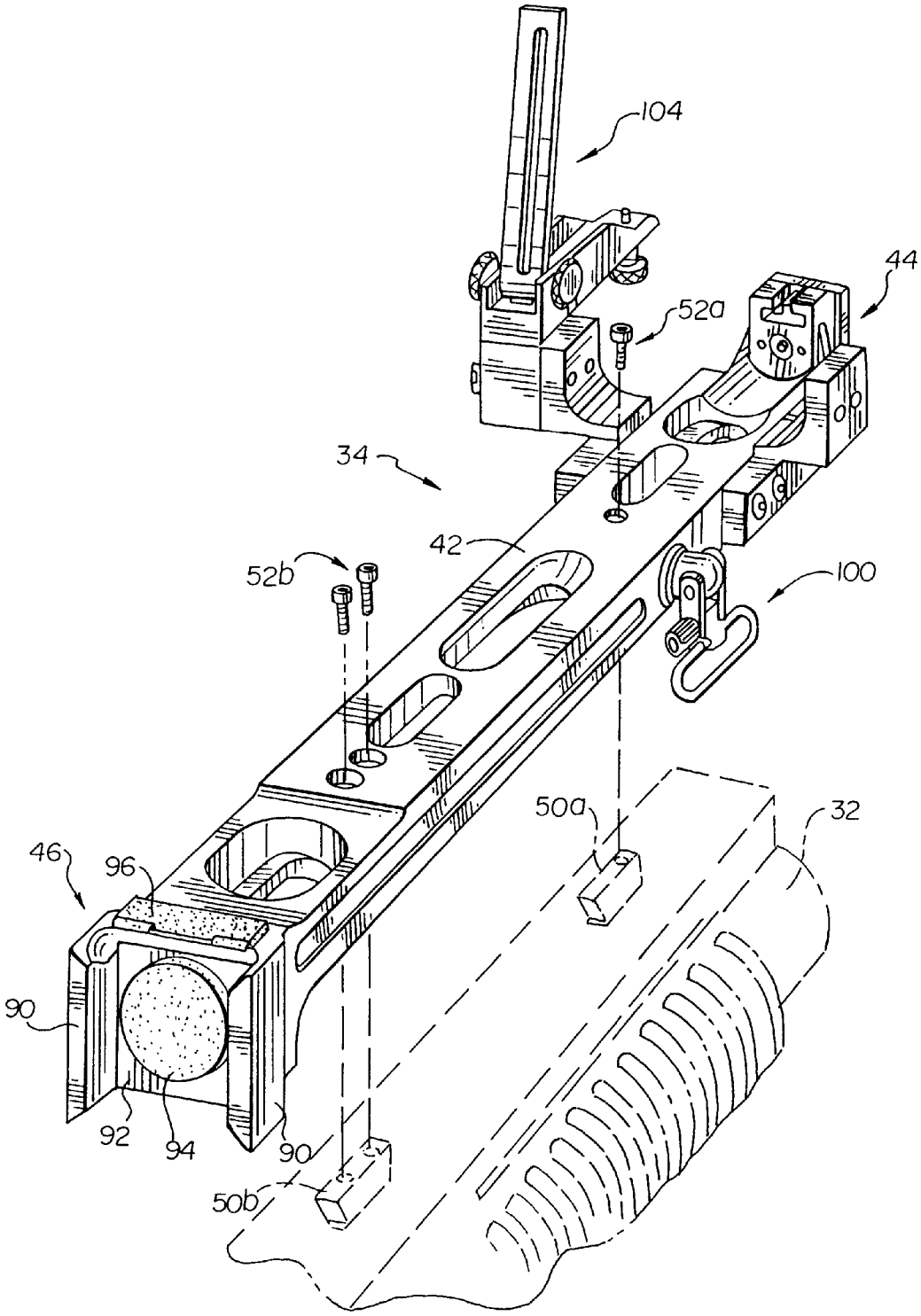
FIG. 8 is an exploded perspective view illustrating how various component parts of the present apparatus invention are arranged and assembled.

Prior to describing mounts 44 and 46 in detail, bar 42 will be further described. Bar 42 forms a pair of grooves 48 suitable for accepting pylons 50 (see FIG. 8) extending upwardly from the barrel of a grenade launcher or other supplemental device. Once the pylons 50 are positioned within the grooves 48, threaded fasteners 52 are used to vertically secure interbar 42 to the pylons 50. See FIG. 8, noting that an "a" following a given reference numeral indicates that the component, etc. is located toward the forward end of bar 42. This attachment technique, or one very similar to this, is disclosed in U.S. Pat. No. 4,733,489, incorporated herein by reference, but in the case of the '489 patent the technique is used to attach a grenade launcher to a "lower rack" rather than to an entire interbar such as interbar 42. It should be recognized, however, that any suitable connection technique between the supplemental device and interbar 42 could be used. In fact, as discussed above, an interbar structure could actually be affixed to the supplemental device in any number of ways, or even be integral with and not separate from the supplemental device. Importantly, the process of attaching the supplemental device to the interbar assembly, whichever attachment technique is employed, would preferably be completed well prior to active field activities, so that operators would not be required to deal with tools, threaded fasteners, and the like during active field operations.

Figure 9:
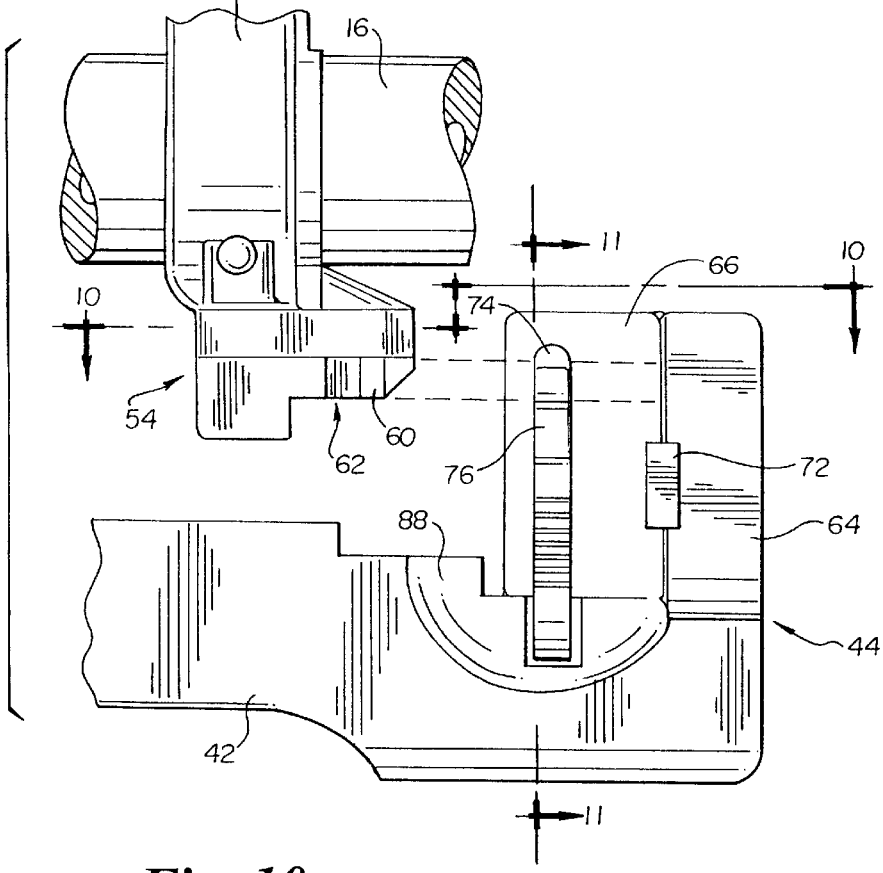
FIG. 9 is a much enlarged right side elevational view of the interbar assembly front mount and the bayonet lug of the preferred host weapon, illustrating how they interconnect.
Figure 10:
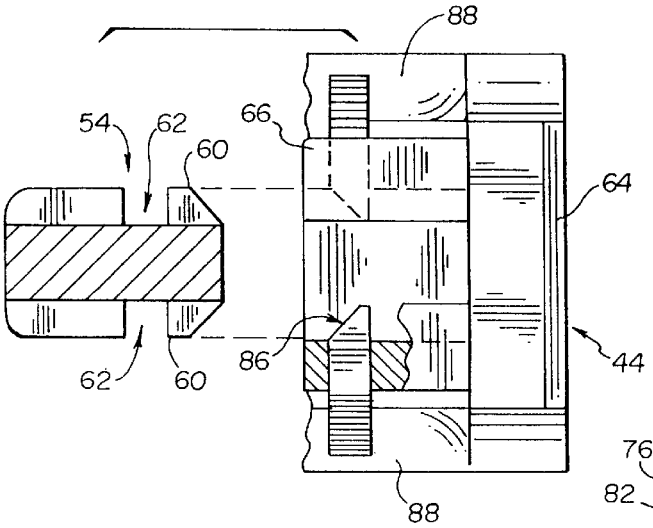
FIG. 10 is a top plan view taken generally along the line 10—10 of FIG. 9.

Front mount 44 is designed to easily and securely attach to a "bayonet attachment point," preferably a bayonet lug 54 shown much enlarged (relative to FIG. 1) in FIGS. 9 and 10. Bayonet lug 54 is rigidly affixed to the underside of the barrel forward end 20, directly beneath the forward sight 22. Bayonet lug 54 can support a bayonet (not shown), of course; but lug 54 can also help support and secure a supplemental device such as grenade launcher 32 pursuant to the present invention, as discussed below.

The preferred bayonet lug 54, on an M16 rifle, is in the nature of a small somewhat T-shaped metal structure having a narrower top and a wider bottom. The rear upper corner of the lug 54 is attached to a bracket 56 for the forward sight 22. A front tip 58 of the lug 54 has a blunt middle section that carries a pair of tip extensions 60 that extend out laterally and taper rearwardly. Behind tip extensions 60 is a notch 62. The geometry of lug 54 is advantageously employed by Applicant to help secure a supplemental device (such as grenade launcher 32) to rifle 10, as further described below. The invention contemplates that there could be various types of bayonet attachment points, depending on the particular host weapon.

Figure 3:
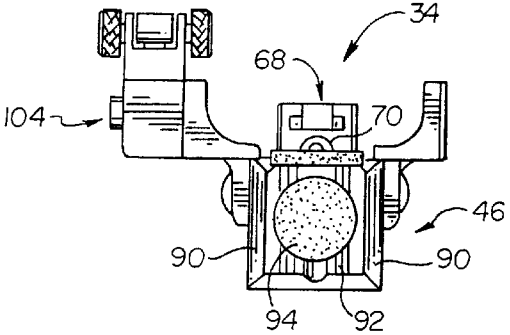
FIG. 3 is an enlarged end elevational view of the interbar assembly rear mount.
Figure 5:
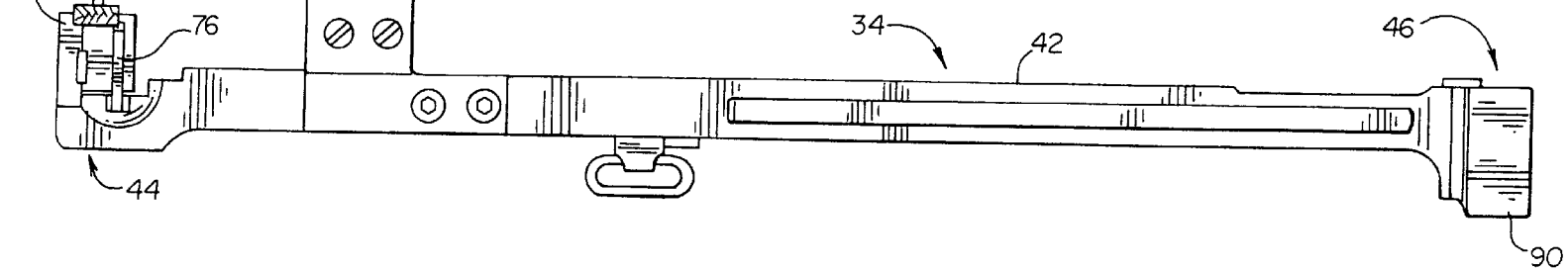
FIG. 5 is an enlarged left side elevational view of the interbar assembly in accordance with present invention, with the host weapon and supplemental device removed.
Figure 6:
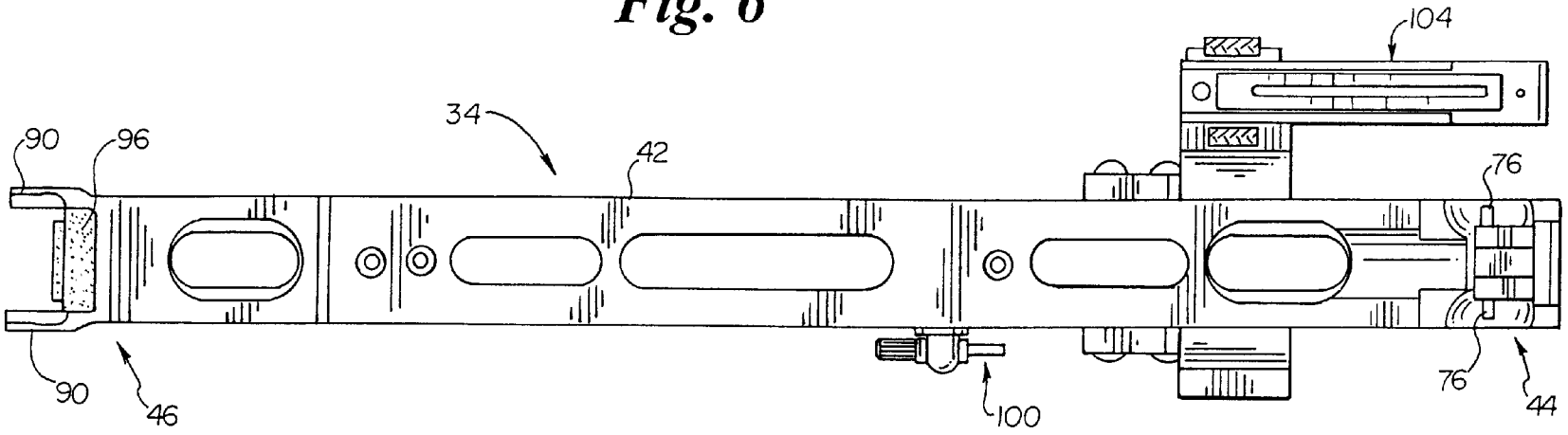
FIG. 6 is a top plan view of the interbar assembly in accordance with present invention, with the host weapon and supplemental device removed.
Figure 7:
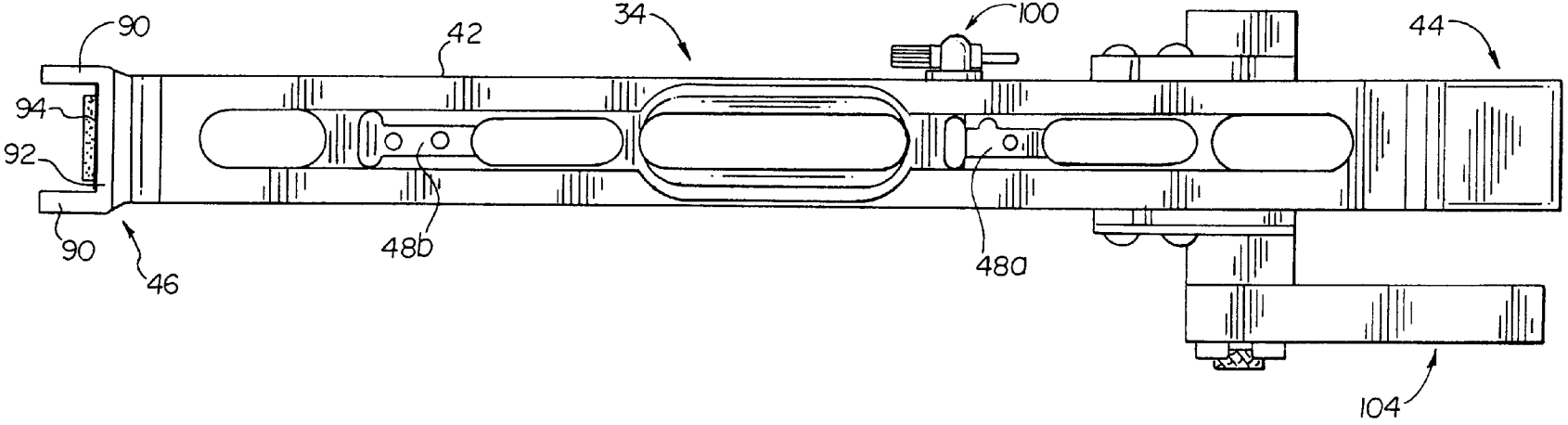
FIG. 7 is a bottom plan view of the interbar assembly in accordance with present invention, with the host weapon and supplemental device removed.

Attention can now be turned to front mount 44. Front mount 44 includes, in a preferred embodiment, a forwardmost roughly square shaped flange 64 (on end view) that extends upwardly from the upper surface of bar 42. Flange 64 can be integral with the metal bar stock that is used to form the main bar 42. Secured to flange 64 is a roughly cube-shaped block 66 that forms a horizontal T-shaped track 68 (see FIG. 3) toward its top surface, slot 68 being sized and configured to slidably accept bayonet lug 54. Block 66 is secured to flange 64 with a threaded fastener 70 (see FIGS. 3 and 8). And a small rectangular key 72 resides within horizontal grooves in flange 64 and block 66 and helps register the parts and prevent unwanted rotation of block 66 relative to flange 64 or vice versa.

Figure 11:
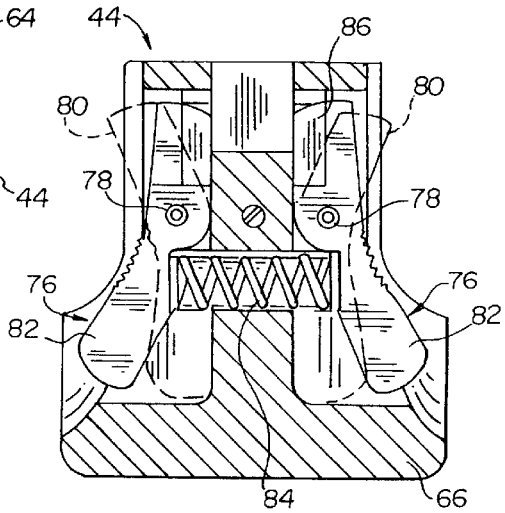
FIG. 11 is a sectional view of the front mount taken generally along line 11—11 of FIG. 9.

The tip extensions 60 of bayonet lug 54 fit within the portions of the T-shaped track 68 that extend outwardly from the center, and the center of lug 54 is received within the central open slot formed at the top of block 66. Vertical slots 74 (see FIG. 9) are machined or otherwise formed in the sides of block 66, toward the rear thereof, so that block 66 can slidably accept a pair of small metal locking pawls 76 that each pivot about a pin 78 that is aligned parallel to the longitudinal axis of bar 42. Referring to FIG. 11, each pawl 76 has a generally chevron shape with an upper ear 80 extending generally vertically and a lower ear 82 extending generally vertically as well, but angled outwardly slightly (when the associated upper ear 80 is oriented vertically). Pin 78 is located roughly at the midpoint between the "ears" of a given pawl 76. This pawl geometry is such that when the upper ears 80 are vertical the lower ears protrude outwardly, and vice versa. The significance of this is described below.

A compression spring 84 internal to block 66 engages the inner edges of lower ears 82 and resiliently urges lower ears 82 outwardly and thus upper ears 80 inwardly, this being the "unactivated" state of pawls 76 as shown in solid line in FIG. 11; phantom line indicates the "activated" state of pawls 76, when their lower ears 82 are pinched together by the operator.

When bayonet lug 54 is locked into front mount 44, lug 54 is fully inserted into block 66 and pawl upper ears 80 reside in notches 62 of lug 54. This prevents the lug 54 from inadvertently being removed from block 66. When the pawl lower ears 82 are pinched toward one another with sufficient force to overcome the force produced by spring 84, this causes the pawl upper ears 80 to pivot outwardly, thus clearing the upper ears 80 from T-track 68, and thus enabling removal of bayonet lug 54 from block 66.

The manner in which the pawls 76 interact with the bayonet lug 54 makes this design particularly useful. For example, the tapered tip extensions 60 of lug 54 act against similarly-angled front surfaces 86 of pawl upper ears 80 to in effect automatically cam the upper ears 80 outwardly, during the supplemental device attachment process. So it's not necessary, in the preferred embodiment, for the operator to continue to pinch the lower pawl ears 82 during the attachment process. And once the tapered tip of lug 54 has sufficiently entered block 66, the upper ears 80 of spring-loaded pawls 76 snap into notches 62 formed behind the tapered lug tip, so as to fully capture and lock the lug 54 within the block 66. This secures interbar assembly 34 against axial and rotational movement relative to lug 54 and barrel 16. Then, when it is desired to detach the supplemental device, e.g., the grenade launcher, the operator simply pinches together the lower ears 82 of the pawls 76, so as to clear the upper ears 80 from the T-track 68 to permit the lug 54 to be removed from block 66.

It should be noted that bar 42 has two bowl-like finger cutouts 88 formed in it to permit ready access to the lower ears 82 of the pawls 76 while at the same time protecting the pawls and preventing inadvertent actuation of the pawls 76 by, for example, accidentally bumping the pawl(s) 76 against something.

Another useful feature of the preferred pawl design is that it is necessary to push both lower ears 82 inwardly in order to release lug 54 from block 66. This is another safety feature, in that it is unlikely that both of the lower ears82 would be inadvertently engaged at the same time.

Also note that the bar 42 itself, beneath block 66, is slotted to partially receive lower pawl ears 82. This enables pawls 82 to be longer to increase their mechanical advantage, and renders them easier to activate.

Figure 2:
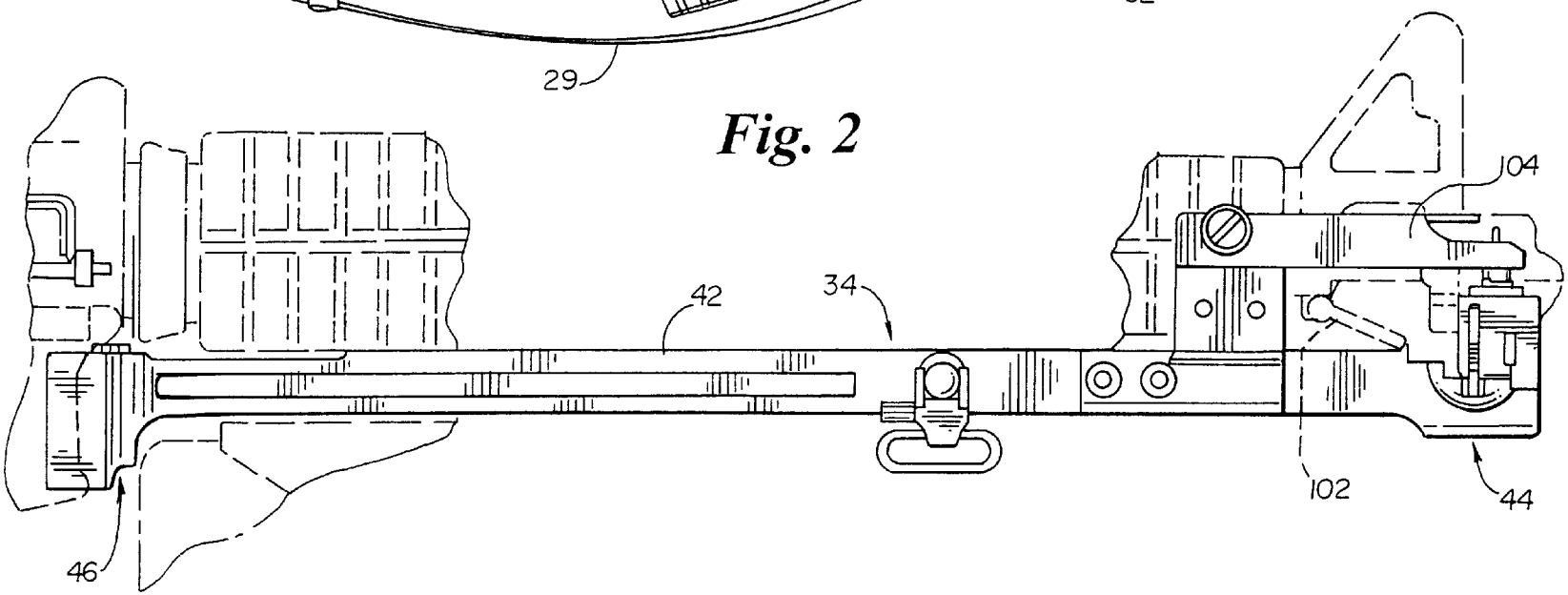
FIG. 2 is an enlarged right side elevational view of the interbar assembly in accordance with the present invention, with the host weapon and supplemental device in phantom.
Figure 4:
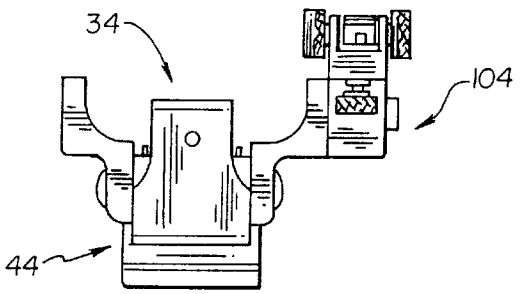
FIG. 4 is an enlarged end elevational view of the interbar assembly front mount.

Attention is now turned to the rear mount 46, shown in FIGS. 1–8. Rear mount 46 includes a pair of "winglets" 90. Winglets 90 are relatively thin, rectangular, rearwardly extending structures that are substantially parallel to one another and spaced apart from one another a distance slightly greater than the thickness of magazine well 31, for reasons that will be apparent below. The winglets 90 form a yoke or brace that accepts magazine well 31, as shown in FIGS. 1 and 2, to brace interbar assembly 34 against rifle 10, and help prevent rotational relative movement therebetween. Importantly, the present invention contemplates that the rear of the interbar assembly 34 could be braced against any suitable structure located in the breech area (herein referred to as "breech bracing structure") depending on a variety of factors, e.g., the exact configuration of the host weapon.

The winglets 90 combine to form a box of sorts, open at the rear, top and bottom; but having sides (i.e., the winglets themselves) and a substantially vertical front wall 92, proximate bar 42. The height of the winglets corresponds roughly to the height of the magazine well 31. As noted above, the side-to-side distance between winglets 90 is slightly greater than the thickness, side-to-side, of the magazine well 31, so that the winglets 90 can easily slide onto magazine well 31. The front wall 92 of the winglet box preferably carries a resilient pad 94 that may help absorb the impact caused by firing the grenade launcher and helps ensure a snug interface to the host. Pad 94 can be an elastomeric disk, as depicted in the drawings. The winglet box also includes a rubber buffer pad 96 at the top toward the front wall 92 to further insure snug interface to the host weapon.

It should also be noted that magazine well 31 has a lip 98 that encircles its lower edge. Lip 98 extends outwardly slightly, and it is presumed that the original purpose of this lip was to strengthen the lower edge of magazine well 31, and also to render it smoother and make it easier to insert the ammunition clip into the well 31. Applicant has advantageously used lip 98, to brace the lower edges of winglets 90. That is, lip 98 helps prevent rear mount 46 from moving downwardly relative to the magazine well 31, to further secure the rear mount 46 to rifle 10.

It should further be noted that magazine well 31 may not be the only "breach bracing structure" that a rear mount could interface with, but it is the preferred such structure.

Finally, it should be noted that the winglets 90 extend downwardly beneath the lower surface of the bar 42. This is done to better register the winglets 90 with the magazine well 31, just as the front mount 44 is elevated slightly relative to the top surface of bar 42, to register it with bayonet mount 54.

A preferred interbar assembly 34 also includes a supplemental sling strap attachment point 100, sometimes referred to herein as a SSSAP. When any supplemental device is attached to a host weapon, the forward sling strap attachment must be modified to move the sling out of the trajectory of the projectile, e.g., grenade. Usually this is done by the addition of a supplemental sling strap attachment point on the host weapon itself, using tools. Lacking a supplemental sling strap attachment point on the host, operators often improvise an informal method of attaching the strap to the host firearm. This can cause safety or reliability problems. The present invention includes a SSSAP 100 on the interbar assembly 34, so that no modification of the host is necessary, or informal field "solutions." The SSSAP 100, as part of the interbar assembly 34, or as part of a supplemental device/interbar assembly combination as discussed at length above, precludes the need to further modify the host weapon or for improvisation by the operator. Strap 29 is simply moved from the normal host attachment point 102 (see FIG. 2) to the SSSAP 100 by the operator, quickly and without tools.

A preferred interbar assembly 34, or interbar/supplemental device combination, also includes a supplemental device sight 104. A preferred sight 104 is a folding-blade leaf sight designed for mounting on either the left or right side of the interbar assembly 34. Leaf sight 104 can be easily operated by one hand for all adjustments. The adjustments for windage and elevation are ambidextrous. The sight can be moved to the opposite side of the interbar assembly 34 by the operator quickly, easily and without the need for tools, to accommodate the operator's dominant eye. A preferred embodiment of sight 104 is secured to the interbar assembly by screws, but a standard 40 mm cartridge case rim can be used to loosen and tighten the sight block retaining screws which allow the repositioning of the sight from side to side.

In the case where the "supplemental device" is a grenade launcher, a preferred sight 104 is functional from 100 to 400 meters and is graduated in 50 meter increments. 100 meter marks can be identified by the number of dots representing the range in hundreds of /meters. Dot markings allow the system to easily be used by operators familiar only with Arabic numerals.

In operation, the supplemental device, e.g., grenade launcher 32, is connected to the interbar assembly 34 using threaded fasteners 52 or the like. Or, as discussed repeatedly above, the interbar assembly can actually be part of or integral with the supplemental device. Then, if desired, a supplemental device sight 104 can be secured to the interbar assembly, to the right or left depending on the operator's dominant eye. Importantly, these steps can be taken before going out into the field, although they can be performed in the field. Alternatively, the system is configured to allow them to be done easily in the field. The host weapon 10 is preferably not materially modified (and most preferably not modified in any way whatsoever), so its weight is not increased, its balance is not detrimentally affected, and its effectiveness as a dedicated single-purpose weapon is not diminished in any way.

The remaining steps are typically though not necessarily taken in the field. When it is desired to attach the supplemental device (e.g., grenade launcher 32) to the host weapon (e.g., rifle 10), the sling strap 29 of the host weapon is preferably disconnected from its normal attachment point 102 at the forward end of the barrel. Then, the interbar assembly/supplemental device assembly is positioned below the barrel of rifle 10 so as to position the winglets 90 around magazine well 31 and to align the T-track 68 with bayonet lug 54. Then, the interbar assembly/supplemental device assembly is pushed or rapped rearwardly relative to the host weapon, so that the tapered tip of lug 54 engages and cams the upper ears 80 of pawls 76 outwardly, to clear the slot and enable lug 54 to proceed into the T-track 68. Once sufficiently inserted, upper ears 80 of spring-loaded pawls 76 will snap into notches 62 formed in lug 54. This fully captures lug 54 within block 66, and precludes any further axial or rotational movement of the interbar assembly relative to the host weapon. At the same time, the winglets 90 of rear mount 46 are slid into position on magazine well 31, with upper pad 96 resiliently engaging a horizontal magazine surface, and forward pad 94 resiliently engaging the magazine well front wall. The interbar assembly, including the supplemental device, is at that point locked to the host weapon.

Once the supplemental device is secured to the host, it is simply a matter of attaching the sling strap 29 to the SSSAP 100 and adjusting the sight 104. If it is necessary to relocate the sight to the other side of the interbar assembly, a 40 mm casing rim can be used to unscrew the threaded fasteners, and then screw them in again once the sight has been relocated to the other side.

Detaching the supplemental device is very simple. The sling strap 29 is removed from the SSSAP 100; the lower ears 82 of pawls 76 are pinched inwardly to release the bayonet lug 54 from the front mount block 66; and the supplemental device is moved forwardly relative to the host to fully disengage the front and rear mounts 44 and 46 from their mating parts on the host weapon. Then the sling strap is reattached to its primary attachment point 102 on the barrel of the host. Following those simple steps, the host is once again in its original configuration, with no extra weight and optimized for dedicated use as a precision, single-purpose firearm. Thus, the supplemental device is "reversibly attached" to the host weapon in the sense that it can be readily attached to the host and then readily detached as well.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An interbar assembly for reversibly attaching a supplemental device to a host weapon having a magazine well and a bayonet lug, comprising:

(a) an elongated interbar carrying the supplemental device, the interbar having a front end and a rear end and a length comparable to the distance between the magazine well and the bayonet lug;

(b) a front mount attached to the front end of the interbar, the front mount being constructed and arranged to receive the bayonet lug; and (c) a rear mount attached to the rear end of the interbar, the rear mount being constructed and arranged to receive the magazine well, whereby the interbar assembly and the supplemental device are secured to the host weapon.

2. The interbar assembly of claim 1, wherein the interbar is not integral with the supplemental device, and the two are connected together.

3. The interbar assembly of claim 2, wherein threaded fasteners are used to connect the interbar to the supplemental device.

4. A system for attaching a supplemental device assembly to a host weapon having a breech bracing structure and a bayonet attachment point, the system comprising:

(a) a front mount attached to the front of the supplemental device assembly, the front mount being constructed and arranged to connect to the bayonet attachment point; and (b) a rear mount attached to the rear of the supplemental device assembly, the rear mount being constructed and arranged to operatively engage the breech bracing structure, whereby the supplemental device assembly is secured to the host weapon.

5. A supplemental device assembly suitable for attachment to an unaltered host weapon having a breech bracing structure and a bayonet attachment point, the supplemental device assembly comprising:

(a) an elongated supplemental device barrel;

(b) an elongated interbar operatively connected to the supplemental device barrel;

(c) a front mount attached to the front of the interbar, the front mount being constructed and arranged to reversibly connect without the need for tools to the bayonet attachment point; and (d) a rear mount attached to the rear of the interbar, the rear mount being constructed and arranged to operatively engage the breech bracing structure without the need for tools, whereby the supplemental device assembly is reversibly secured without tools to the unaltered host weapon.

6. The supplemental device assembly of claim 5, wherein the interbar is not integral with the supplemental device receiver, and the two are connected together.

7. The supplemental device assembly of claim 6, wherein threaded fasteners are used to connect the interbar to the supplemental device receiver.

8. A weapon system comprising:

(a) a host weapon comprising a breech bracing structure and a bayonet attachment point;

(b) a supplemental device assembly comprising an elongated barrel and an elongated interbar operatively connected thereto;

(c) a front mount attached to the front of the interbar, the front mount being constructed and arranged to reversibly connect to the bayonet attachment point; and (d) a rear mount attached to the rear of the interbar, the rear mount being constructed and arranged to operatively engage the breech bracing structure, whereby the supplemental device assembly is reversibly secured to the host weapon, and whereby the host weapon can be used as a single-purpose dedicated weapon or the supplemental device assembly can be attached to the host weapon to create a dual-purpose weapon.

9. An interbar assembly for reversibly attaching a supplemental device to a host weapon, the host weapon having a butt, a barrel, a breech portion, a sling strap having a barrel end and a butt end, a butt sling strap attachment point and a barrel sling strap attachment point, and the interbar assembly comprising:

(a) an elongated interbar having a front end and a rear end, the interbar carrying the supplemental device;

(b) a front mount attached to the front end of the interbar, the front mount being constructed and arranged to reversibly connect proximate the host weapon barrel;

(c) a rear mount attached to the rear end of the interbar, the rear mount being constructed and arranged to reversibly connect proximate the breech portion of the host weapon; and (d) a supplemental sling strap attachment point located on the interbar, wherein the barrel end of the sling strap may be relocated from the barrel sling strap attachment point to the supplemental sling strap attachment point when the interbar assembly is attached to the host weapon.

10. The interbar assembly of claim 9, wherein the interbar is not integral with the supplemental device, and the two are connected together.

11. The interbar assembly of claim 10, wherein threaded fasteners are used to connect the interbar to the supplemental device.

12. An interbar assembly for reversibly attaching a supplemental device to a host weapon having a barrel, a breech portion, and a host weapon sight, the interbar assembly comprising:

(a) an elongated interbar having a front end and a rear end, the interbar carrying the supplemental device;

(b) a front mount attached to the front end of the interbar, the front mount being constructed and arranged to reversibly connect proximate the host weapon barrel;

(c) a rear mount attached to the rear end of the interbar, the rear mount being constructed and arranged to reversibly connect proximate the breech portion of the host weapon; and (d) a supplemental device sight located on the interbar.

* * * * *